US007618010B2

(12) United States Patent
Fries

(10) Patent No.: US 7,618,010 B2
(45) Date of Patent: Nov. 17, 2009

(54) METHOD, COMPUTER SOFTWARE CODE, AND SYSTEM FOR DETERMINING A TRAIN DIRECTION AT A RAILROAD CROSSING

(75) Inventor: Jeffrey M. Fries, Lee's Summit, MO (US)

(73) Assignee: General Electric Company, Schenectady, NY (US)

( * ) Notice: Subject to any disclaimer, the term of this patent is extended or adjusted under 35 U.S.C. 154(b) by 542 days.

(21) Appl. No.: 11/533,384

(22) Filed: Sep. 20, 2006

(65) Prior Publication Data

US 2008/0067293 A1 Mar. 20, 2008

(51) Int. Cl.
*B61L 1/00* (2006.01)

(52) U.S. Cl. ..... 246/122 R; 246/125; 246/292; 246/293; 701/19

(58) Field of Classification Search ..... 701/19, 701/20; 246/34 R, 34 A, 34 B, 34 CT, 122 R, 246/125, 126, 127, 128, 129, 218, 219, 246, 246/249, 255, 130, 292, 293, 473.1
See application file for complete search history.

(56) References Cited

U.S. PATENT DOCUMENTS 3,838,271 A 9/1974 Ackard et al.
4,307,860 A 12/1981 Kuhn
5,330,136 A * 7/1994 Colbaugh ..... 246/122 R
6,179,252 B1 1/2001 Roop et al.
6,360,998 B1 3/2002 Halvorson et al.
6,386,486 B1 5/2002 Speranza
2004/0181321 A1 * 9/2004 Fries et al. ..... 701/19

FOREIGN PATENT DOCUMENTS

WO WO 2004/071839 8/2004

* cited by examiner

*Primary Examiner*—Mark T Le
(74) *Attorney, Agent, or Firm*—Robert Wawrzyn, Esq.; Terry M. Sanks, Esq.; Beusse Wolter Sanks Mora & Maire, P.A.

(57) ABSTRACT

In a railroad crossing warning system having an electronic transmitter located on a first side of a road crossing connected across both railway rails, a first electronic receiver on the first side of the road crossing connected across both railway rails, a second electronic receiver on the second side of the road crossing connected across both railway rails, a method for determining direction a vehicle is traveling, the method including monitoring a voltage profile from at least one of the first receiver and the second receiver, as a vehicle moves along the railway rails towards the road crossing, and determining a direction the vehicle is moving based on the voltage profile.

15 Claims, 2 Drawing Sheets

METHOD, COMPUTER SOFTWARE CODE, AND SYSTEM FOR DETERMINING A TRAIN DIRECTION AT A RAILROAD CROSSING

FIELD OF INVENTION

This field of invention relates to rail transportation and, more specifically, to a method, computer software code, and a system for determining a direction a vehicle is traveling on a railway track.

BACKGROUND OF THE INVENTION

Fixed rail transportation systems, that include one or more rail vehicles traveling over spaced apart rails of a railway track, have been an efficient way of moving cargo and people from one geographical location to another. In densely populated countries and countries having unimproved road transportation systems, rail vehicles may be the primary means for moving people and cargo. Additionally, rail transportation is used in areas where little to no population exists. Accordingly, there are probably millions of miles of railroad track throughout the world that need to be maintained. Because road transportation is also prevalent, roads are known to bisect, and or cross, railway tracks. Typically, a crossing warning system is located where a road crosses railroad tracks. There are probably hundreds of thousands of crossing warning systems in operation today.

Most crossing warning systems currently used in the United States are crossing predictors. Crossing predictors provide a constant warning time of train arrival to motorists at the crossing, regardless of train speed. These are commonly used in the United States due to the many railroad lines with mixed traffic speeds (heavy freight vs. light passenger). Such systems do not take into account train direction. Such systems typically have only been concerned with constant warning. Thus, regardless of train direction, as a train moves towards a crossing, from either side, a measured impedance will decrease proportional to train speed. More specifically, these systems measure electrical impedance of the rail as a train moves towards the crossing. The rate of change of the impedance is proportional to the train speed, and along with the known distance of the crossing approach length, can be used to predict the estimated time to crossing of the train. Thus, these systems predict when the train will arrive at the crossing, thus providing a constant warning time to the motorist, regardless of varying train speed.

European crossing warning systems and a limited number of systems in the United States use axle counters or treadles to magnetically, or mechanically, count train axles. These sensors may be wired together on either side of the crossing to determine train direction. However, these systems have proven unreliable and expensive. Furthermore, they have proven not to provide constant warning to motorist.

New crossing monitoring systems are being developed to automatically record and document the performance of crossing warning devices as trains pass by, but these new systems do not readily lend themselves to determining a direction that a passing train is traveling. Thus, such new systems still require an additional element to be able to determine a direction a train is traveling.

Railroad owners and/or users of railroads spend a significant amount of time and money adhering to Federal Railroad Administration (FRA) mandated testing of crossing warning systems. The FRA requires monthly testing of crossing warning systems to insure that they operate properly. Since each approach track on either side of the crossing provides its own independent warning time, verification of these systems should be performed for trains traveling in both directions. These tests are generally performed manually, such as by waiting for a train to move through a crossing or by driving a railroad maintenance vehicle through a crossing and monitoring the warning time, gate/light/bell activation. Since the systems should be tested for vehicles approaching in each direction, either the testers must wait for trains to travel in both directions or drive their maintenance vehicles through the crossing in both directions. Performing these tests amounts to a significant amount of time and money, especially considering the number of active crossings that currently exist.

FIG. 1 depicts a prior art embodiment of a railroad crossing system 25. As illustrated, the railway rails 10 are intersected by a road crossing 12. On one side of the road crossing 12 a transmitter 13 is connected across the rails. On both sides of the road crossing a receiver 14, 15 is connected across the rails 10. One receiver 14 senses a transmit voltage, TV, and the other receiver 15 senses a receive voltage, RV. Furthermore, the transmit voltage receiver 14 may or may not share the same connections to the rails 10 as the transmitter 13.

The distance between the receivers 14, 15 is generally referred to as an island 18. Located on both sides of the road crossing 12 are termination shunts 16 which are connected across the rails 10. The termination shunts 16 contain transmitted signals that are associated with that section of the track 10. The distance between a termination shunt 16 and the closest transmitter 13 and/or receiver 14, 15 is commonly referred to as an approach 20. The approach 20 is effectively a surveillance area for the crossing predictor to monitor trains.

Thus, as a train moves towards the crossing 12, from either side, transmit voltage (TV) and receive voltage (RV) are monitored to calculate an electrical impedance seen by the crossing predictor. As the train gets closer, the electrical impedance decreases proportional to the speed of the train. This is due to the train wheel axles acting as an electrical shunt. Knowing the fixed approach distance, the speed of the train can be used to estimate a time the train will arrive at the crossing and provide constant warning time, such as but not limited to, by activating lights, gates, bells, etc. 9, to a motorist at the road crossing 12, regardless of train speed.

A solution is therefore needed for determining a direction a vehicle is traveling on a railway track as it approaches a road crossing so that the significant amount of time and money spent by Railroad owners and/or users of railroads adhering to requirements, such as those mandated by the FRA, to test crossing warning systems is limited.

BRIEF DESCRIPTION OF THE INVENTION

Embodiments of the invention are directed towards a method, computer software code, and system for determining a direction a vehicle is traveling on a railway track. Towards this end, in an exemplary embodiment, where there is a railroad crossing warning system having an electronic transmitter located on a first side of a road crossing connected across both railway rails, a first electronic receiver on the first side of the road crossing connected across both railway rails, a second electronic receiver on the second side of the road crossing connected across both railway rails, a method for determining direction a vehicle is traveling is disclosed. The method includes monitoring a voltage profile from at least one of the first receiver and the second receiver, as a vehicle moves along the railway rails towards the road crossing, and determining a direction the vehicle is moving based on the voltage profile.

In another exemplary embodiment, for a railroad crossing warning system having a processor, an electronic transmitter located on a first side of a road crossing connected across both railway rails, a first electronic receiver on the first side of the road crossing connected across both railway rails, a second electronic receiver on the second side of the road crossing connected across both railway rails, a computer software code for determining direction a vehicle is traveling is disclosed. The computer software code includes a computer software module for monitoring a voltage profile from at least one of the first receiver and the second receiver, as a vehicle moves along the railway rails towards the road crossing, and a computer software module for determining a direction the vehicle is moving along the railway rails based on the voltage profile.

In yet another exemplary embodiment, a system for activating a road crossing gate system and determining a direction a vehicle is traveling on a railroad track is disclosed. The system includes a transmitter located on a first side of a road crossing the railroad track connected across both railway rails. A first receiver on the first side of the road crossing connected across both railway rails, and a second receiver on a second side of the road crossing connected across both railway rails are also disclosed. A processor in communication with the transmitter, the first receiver, and the second receiver is also provided. The processor is configured to determine a direction the vehicle is traveling along the railway rails by determining a first voltage profile from the first receiver as a vehicle moves towards the road crossing and/or a second voltage profile from the second receiver as the vehicle moves towards the road crossing.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAIL DESCRIPTION OF THE INVENTION

Figure 1:
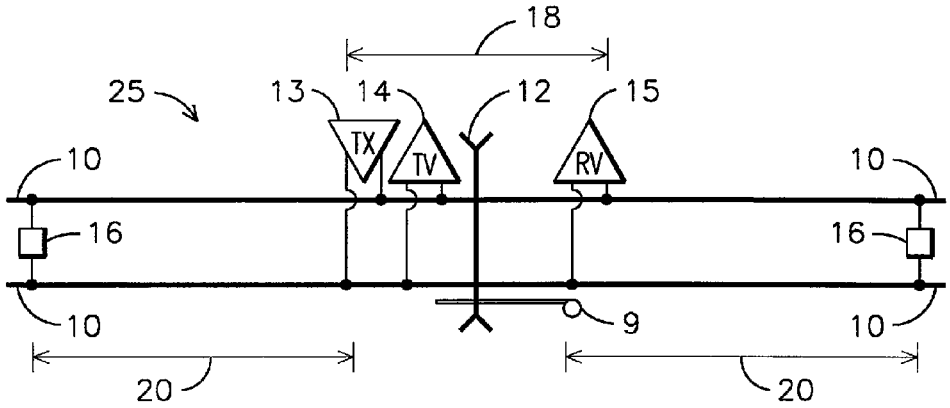
FIG. 1 (PRIOR ART)
FIG. 1 depicts a prior art embodiment of a railroad crossing system.

Reference will now be made in detail to the embodiments consistent with the invention, examples of which are illustrated in the accompanying drawings. Wherever possible, the same reference numerals used throughout the drawings refer to the same or like parts. Though this invention is described with respect to rail vehicles, such as but not limited to trains and/or railway maintenance vehicles, those skilled in the art will readily recognize that the present invention may also be used for other vehicle systems, such as, but not limited to, where vehicles move over a given surface and other surfaces used where other vehicles, such as but not limited to non-rail vehicles, move along another surface that intersect with and/or bisects the first given surface.

Embodiments of the present invention solve the problems in the prior art by providing a system, method, and computer implemented method, such as but not limited to a computer software code, for determining a direction a train is traveling on a railway track. Persons skilled in the art will recognize that an apparatus, such as a data processing system, including a CPU, memory, I/O, program storage, a connecting bus, and other appropriate components, could be programmed or otherwise designed to facilitate the practice of the method of the invention. Such a system may include appropriate program means for executing an embodiment of a method of the invention.

Also, an article of manufacture, such as a pre-recorded disk or other similar computer program product, for use with a data processing system, could include a storage medium and program means recorded thereon for directing the data processing system to facilitate the practice of the method of the invention. Such apparatus and articles of manufacture also fall within the spirit and scope of the invention.

Broadly speaking, the technical effect is determining a direction a vehicle is traveling on a railway track. To facilitate an understanding of embodiments of the present invention, it is described hereinafter with reference to specific implementations thereof. The invention may be described in the general context of computer-executable instructions, such as program modules, being executed by a computer. Generally, program modules include routines, programs, objects, components, data structures, etc. that performs particular tasks or implement particular abstract data types. For example, the software programs that underlie the invention can be coded in different languages, for use with different platforms. Examples of embodiments of the invention may be implemented in the context of a web portal that employs a web browser. It will be appreciated, however, that the principles that underlie embodiments of the invention can be implemented with other types of computer software technologies as well.

Moreover, those skilled in the art will appreciate that embodiments of the invention may be practiced with other computer system configurations, including hand-held devices, multiprocessor systems, microprocessor-based or programmable consumer electronics, minicomputers, mainframe computers, and the like. Embodiments of the invention may also be practiced in distributed computing environments where tasks are performed by remote processing devices that are linked through a communications network. In a distributed computing environment, program modules may be located in both local and remote computer storage media including memory storage devices.

Referring now to the drawings, embodiments of the present invention will be described. Embodiments of the invention can be implemented in numerous ways, including as a system (including a computer processing system), a method (including a computerized method), an apparatus, a computer readable medium, a computer program product, a graphical user interface, including a web portal, or a data structure tangibly fixed in a computer readable memory. Several embodiments of the invention are discussed below.

Embodiments of the present invention adapts and/or modifies current crossing warning systems to allow for determining a direction a vehicle is traveling along a railway as it approaches a road crossing. Embodiments of the present invention may use existing infrastructure in addition with the unique characteristics of a transmit voltage, TV, and receive voltage, RV, as the train approaches from either side of the road crossing so as to determine train direction. More specifically, embodiments of the present invention may use two voltage receivers, and/or sensors, one located on each side of the road crossing. The speed of the train, and hence the prediction of warning time, only requires one of these sensors. The purpose for the second voltage sensor is to compare the sensed voltage on either side of the crossing to ensure correct polarity of the track wiring and/or to compare the sensed voltage on either side of the crossing to report a high resistance or broken track wire.

Figure 2:
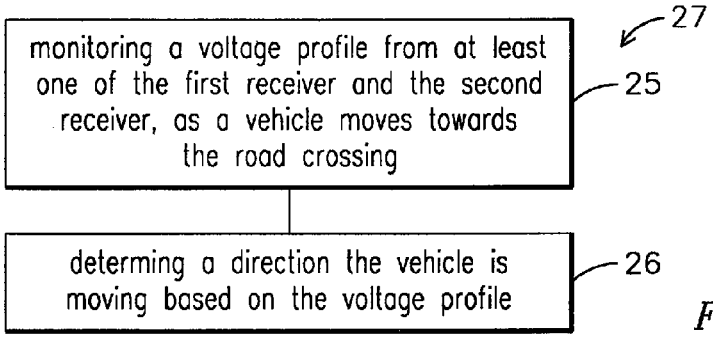
FIG. 2 depicts an exemplary embodiment of a method for determining a direction a vehicle is traveling on a railway track.

FIG. 2 depicts an exemplary embodiment of a flowchart of a method of the present invention. The method 27 may include monitoring a voltage profile from first receiver and/or the second receiver as a vehicle moves along the rails towards the road crossing, step 25. A direction the vehicle is moving is determined based on the voltage profile, step 26. How the direction of travel is determined is further explained below with reference to FIG. 3. As discussed above, one or more of these steps may be implemented using a computer software code that is executed by a computer linked with TX 13, TV 14, and RV 15.

Figure 3:
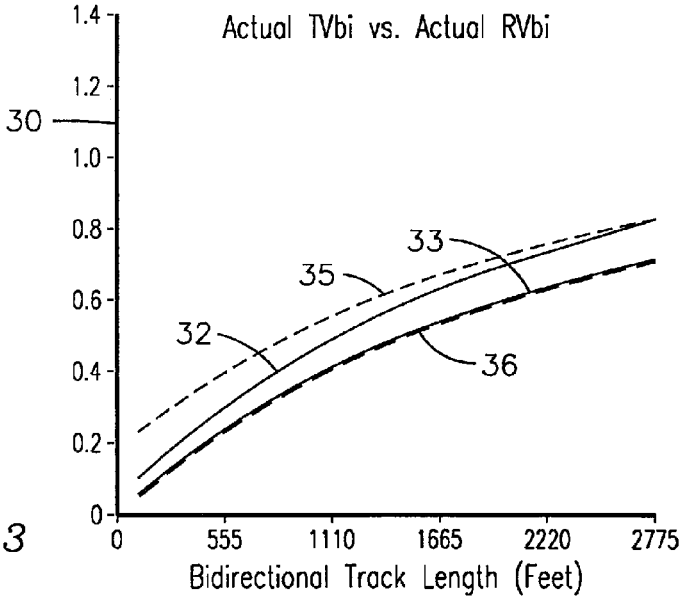
FIG. 3 depicts a graph illustrating first exemplary operations data associated with an embodiment of the invention.

FIG. 3 depicts a graph illustrating first exemplary operations data associated with an embodiment of the invention. More specifically, a graph 30 illustrating transmit voltage, TV, and receive voltage, RV, as the vehicle moves along the rails towards the road crossing, in this case from right to left, or first side to second side. The solid traces 32, 33 illustrate the TV and RV voltage, respectfully, as the vehicle approaches from the first side of the road crossing 12. The dashed traces 35, 36 illustrate the TV and RV voltage, respectfully, as the vehicle approaches from the second side of the road crossing 12. Since the transmit voltage receiver 14 is located closest to the transmitter 13, these graphical lines 32, 35 are generally higher in magnitude than the receive voltage traces 33, 36. Thus, when the vehicle approaches the road crossing from the second side of the road crossing 12, the graphical trace 33 is very similar to the trace 36 when approaching from the first side of the road crossing 12. However, the transmit voltage traces 32, 35 are different depending on vehicle direction. Those skilled in the art will readily recognize that the transmit voltage profile 32, 35 may be characterized across many variables and be used absolutely to determine vehicle direction. Based on the differences in traces 32, 33, 35, 36 in view of a direction the vehicle is approaching, such information may be used to determine the direction the vehicle is traveling.

Figure 4:
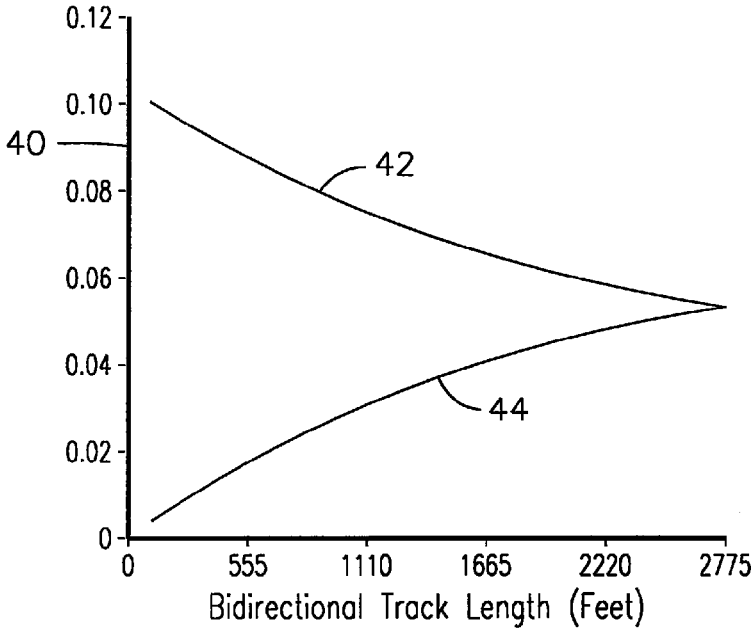
FIG. 4 depicts a graph illustrating second exemplary operations data associated with an embodiment of the present invention.

FIG. 4 depicts a graph illustrating another exemplary embodiment of how the present invention operates. Specifically, this graph 40 is an exemplary illustration of a difference between the transmit voltage and receive voltage, TV-RV, as the vechicle moves towards the crossing 12, from the first side to the second side, or left to right. The first trace 42 illustrates the difference, TV-RV, as train approaches from the second side of the road crossing. The second trace 44 illustrates the difference, TV-RV, as the vehicle approaches from the first side of the road crossing.

The slope of the traces 42, 44 as the vehicle moves towards the crossing is exactly opposite when comparing the graphical lines. As the vehicle approaches from the second side of the crossing, the difference, TV-RV, results in a trace 42 having an increasing slope. As a vehicle approaches from the first side of the crossing 12, the difference, TV-RV, results in a trace 44 having a decreasing slope. This relationship exists regardless of other variables associated with the system, such as but not limited to frequency, approach length, ballast resistance, etc. Therefore, in an exemplary embodiment, no variation in the results is introduced due to external factors. This graphical representation occurs because the approaching vehicle shunt will cause the voltage receiver 14, 15 that is closest to it to decrease faster than the other voltage receiver. For example, if the vehicle approaches from the second side, the receive voltage 15 will decay quicker than the transmit voltage 14, thus causing an increasing slope on the TV-RV difference.

Once a train has moved through the crossing 12, the vehicle direction can be logged for that vehicle. In an exemplary embodiment, this information is then available to later verify that the crossing warning system is functioning properly. Towards this end, the information may be stored in a storage device 60, illustrated in FIG. 5, at the crossing warning system. In another exemplary embodiment, this information may be communicated to, but not limited to, a monitoring systems and/or an automated test system. Such communications may occur at predetermined intervals and/or after the vehicle crosses. Towards this end, a communication device 62, such as a transceiver, may also be present, as illustrated in FIG. 5.

Embodiments of the invention may provide a software upgrade for one or more prior art crossing warning systems. Utilizing a software upgrade provided by an embodiment of the present invention, one or more prior art systems will be able to determine vehicle direction. Such determinations may be accomplished automatically.

Figure 5:
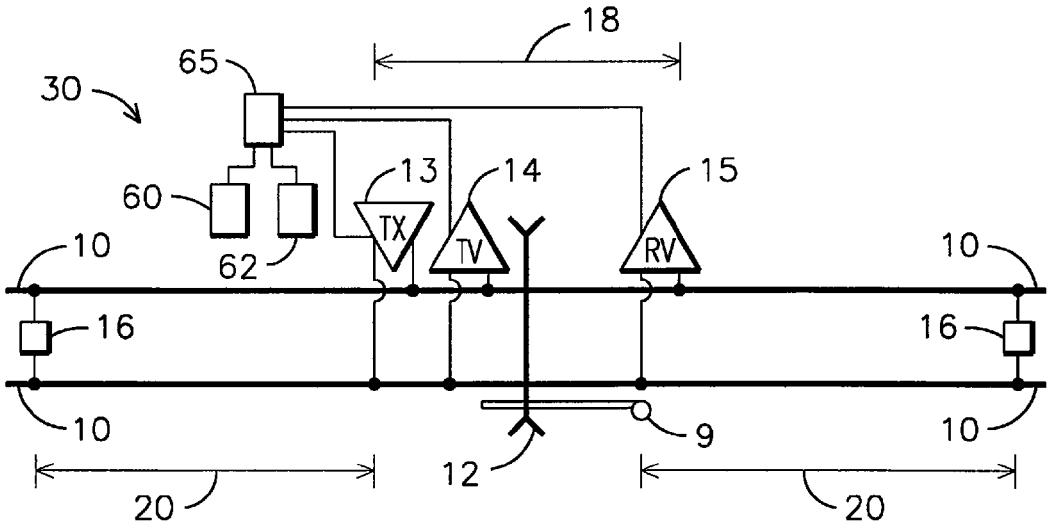
FIG. 5 depicts an exemplary embodiment of an improved railway crossing warning system.

FIG. 5 depicts an exemplary embodiment of an improved railway crossing warning system. The system 30 has a transmitter 13 located on the first side of a road crossing connected across both railway rails 10. A first receiver 14 is on the first side of the road crossing 12 connected across both railway rails 10. A second receiver 15 is on the second side of the road crossing 12 connected across both railway rails 10. A processor 65 is in communication with the transmitter 13, the first receiver 14, and the second receiver 15. The processor 65 is able to determine the direction the vehicle is traveling by determining a first voltage profile from the first receiver 14 as the vehicle moves towards the road crossing 12, and/or a second voltage profile from the second receiver 15 as the vehicle moves along the rails towards the road crossing 12.

While the invention has been described in what is presently considered to be a preferred embodiment, many variations and modifications will become apparent to those skilled in the art. Accordingly, it is intended that the invention not be limited to the specific illustrative embodiment but be interpreted within the full spirit and scope of the appended claims.

What is claimed is:

1. In a railroad crossing warning system having an electronic transmitter located on a first side of a road crossing connected across both railway rails, a first electronic receiver on the first side of the road crossing connected across both railway rails, a second electronic receiver on the second side of the road crossing connected across both railway rails, a method for determining direction a vehicle is traveling, the method comprising:

monitoring a voltage profile from at least one of the first receiver and the second receiver, as a vehicle moves along the railway rails towards the road crossing; and determining a direction the vehicle is moving based on the voltage profile;

comparing a first voltage curve of the first receiver to a second voltage curve of the second receiver, wherein comparing is performed relative to at least a first and a second relationship of the curves, each expected relationship associated with a different direction of vehicle travel; and determining a direction of travel of the vehicle based on comparing the first voltage curve of the first receiver to the second voltage curve of the second receiver.

2. The method of claim 1 wherein monitoring a voltage profile further comprises determining a difference of voltage between the first receiver and the second receiver as the vehicle approaches the road crossing.

3. The method of claim 1 further comprises storing information about the direction the vehicle travels.

4. The method of claim 1 further comprises transmitting information about the direction the vehicle travels to a remote location.

5. The method of claim 1 further comprises sensing voltage associated with at least one of the first receiver and the second receiver as the vehicle moves towards the road crossing.

6. In a railroad crossing warning system having a processor, an electronic transmitter located on a first side of a road crossing connected across both railway rails, a first electronic receiver on the first side of the road crossing connected across both railway rails, a second electronic receiver on the second side of the road crossing connected across both railway rails, a computer software code for determining direction a vehicle is traveling, the computer software code comprising:

a computer software module for monitoring a voltage profile from at least one of the first receiver and the second receiver, as a vehicle moves along the railway rails towards the road crossing; and a computer software module for determining a direction the vehicle is moving along the railway rails based on the voltage profile;

a computer software module for comparing a first voltage curve of the first receiver to a second voltage curve of the second receiver, wherein comparing is relative to at least a first and a second relationship of the curves; and a computer software module for determining a direction of travel of the vehicle based on comparing the first voltage curve of the first receiver to the second voltage curve of the second receiver.

7. The computer software code of claim 6 wherein the software module for monitoring a voltage profile further comprises a software module for determining a difference of voltage between the first receiver and the second receiver as the vehicle approaches the road crossing.

8. The computer software code of claim 6 wherein the software module for determining a direction the vehicle is moving further comprises a software module for evaluating a voltage curve based on a difference in voltage between the first receiver and the second receiver as the vehicle approaches the road crossing.

9. The computer software code of claim 6 further comprises a software module for storing information about the direction the vehicle travels.

10. The computer software code of claim 6 further comprises a software module for transmitting information about the direction the vehicle travels to a remote location.

11. The computer software code of claim 6 further comprises a software module for sensing voltage associated with at least one of the first receiver and the second receiver as the vehicle moves towards the road crossing.

12. A system for activating a road crossing gate system and determining a direction a vehicle is traveling on a railroad track, the system comprising:

a transmitter located on a first side of a road crossing the railroad track connected across both railway rails;

a first receiver on the first side of the road crossing connected across both railway rails;

a second receiver on a second side of the road crossing connected across both railway rails;

a processor in communication with the transmitter, the first receiver, and the second receiver; and wherein the processor is configured to determine a direction the vehicle is traveling along the railway rails by comparing a first voltage curve of the first receiver to a second voltage curve of the second receiver, wherein comparing is relative to at least a first and a second relationship of the curves.

13. The system of claim 12 further comprises a sensor configured to measure at least one of voltage at the first receiver, voltage at the second receiver, and voltage at the transmitter.

14. The system of claim 12 further comprises a storage device to retain information regarding the direction the vehicle travels.

15. The system of claim 12 further comprises a communication device in communication with the processor to communicate the direction the vehicle travels to a remote location.

* * * * *